US005832671A

United States Patent [19]

White

[11] Patent Number: 5,832,671

[45] Date of Patent: Nov. 10, 1998

[54] SECURITY CLOSURE

[75] Inventor: David A. White, Kent, England

[73] Assignee: Vacant Property Security Limited, United Kingdom

[21] Appl. No.: 603,314

[22] Filed: Feb. 20, 1996

[30] Foreign Application Priority Data

| | | | |
|---|---|---|---|
| Feb. 22, 1995 | [GB] | United Kingdom | 9503447 |
| Feb. 22, 1995 | [GB] | United Kingdom | 9503458 |
| Nov. 24, 1995 | [GB] | United Kingdom | 9524096 |

[51] Int. Cl.[6] ..... E05C 21/02; E05D 15/28; E06B 3/68

[52] U.S. Cl. ..... 49/465; 49/246; 49/57

[58] Field of Search ..... 49/141, 57, 50, 49/54, 232, 246, 61, 63, 67, 463, 465, 254, 256; 160/104

[56] References Cited

FOREIGN PATENT DOCUMENTS

| | | |
|---|---|---|
| 812916 | 4/1956 | United Kingdom . |
| 898841 | 6/1962 | United Kingdom . |
| 1230843 | 5/1971 | United Kingdom . |
| 2160248 | 12/1985 | United Kingdom . |
| 2183716 | 6/1987 | United Kingdom . |
| 2247269 | 2/1992 | United Kingdom . |
| 2268531 | 1/1994 | United Kingdom . |
| 2270336 | 3/1994 | United Kingdom . |
| WO89/00637 | 1/1989 | WIPO . |
| WO93/12346 | 6/1993 | WIPO . |

*Primary Examiner*—Daniel P. Stodola
*Assistant Examiner*—Curtis Cohen
*Attorney, Agent, or Firm*—Mason, Kolehmainen Rathburn & Wyss

[57] ABSTRACT

A security closure for covering an opening, e.g., a window, in a building includes a panel having a circumferential sidewall. A support member is securable to extend across the opening in fixed relation thereto, the support member being releasably securable to the interior of the panel away from one edge thereof by a releasable securing device. The support member is fixed at the one edge by a hinged fixing structure which allows the panel to pivot substantially along the one edge away from the opening when the support member is released from the releasable securing device. As a result, an emergency release of the panel can be accomplished.

13 Claims, 11 Drawing Sheets

SECURITY CLOSURE

BACKGROUND OF THE INVENTION

1. Field of the Invention

This invention relates to a security closure for use in covering openings in a building, for example windows or the like.

2. Description of the Prior Art

If a building is left vacant for more than a short period of time, for example to carry out renovation works, it becomes vulnerable to people breaking into the building for the purposes of theft squatting or vandalism. The normal windows of a building do not provide a high degree of security so it is known to cover the windows to make it more difficult to enter into the building.

A rudimentary way of covering a window is to fasten a wooden board over the outside of the window but this is relatively easy to remove by someone determined to enter the building.

A more secure closure for a window is disclosed in UK Patent GB-B-2,160,248 in which a security closure is formed as a metal panel having a circumferential side wall with an inwardly turned rim. The panel is held with the rim against the outside of the opening by means of support beams captively retained by the inwardly turned rim of the panel and which are tied by connecting rods to anchor beams spanning the opening on the inside of the building. The connecting rod is tightened so the wall of the building around the opening is clamped between the panel and the anchor beam.

In order to allow the connecting tie to pass through a convenient position in the opening, for example through an open light in the window, the panel is arranged so that the support beam can slide parallel to the face of the panel whilst being retained by the rim and the support beam is designed so that the connecting tie is slidable along the support and anchor beams thereby allowing the connecting tie to be located at most positions within the plane of the panel. However, such nut and bolt connections are difficult to secure quickly. In some instances the panel slips from position before the connection can be secured. This presents particular difficulties when securing closures on windows on the upper levels of buildings where the panel could fall from the building or unbalance a worker which is particularly hazardous with heavy security closures.

There are a number of disadvantages associated with known security closures of this type, the principle one being that the support beams are prone to sliding out of the desired position as the panel is offered to the building unless great care is taken. This problem is particularly acute with large panels where the support beam is relatively heavy and can, when falling under its own weight, become wedged if it rotates relative to the panel into a skewed position.

SUMMARY OF THE INVENTION

The present invention includes embodiments which seek to address the above disadvantages.

In a first set of embodiments, there is provided a security closure for covering an opening in a building comprising a panel having a circumferential sidewall with inwardly-turned rim portions arranged for captively retaining at least one support member to which a connector can be fastened for use in securing the closure over the opening, the panel and the support member having an interlocking means which, when engaged, prevents lateral movement of the support member along the rim portions and the support members arranged to be removably insertable under the rim portions of the panel, the support member being telescopic so it can be reduced in length for insertion within, and removal from, a pair of opposed the side wall of the panel and then extended so the ends of the support member can engage the inwardly turned rim to be retained thereby. The fact that the support members are removable allows the number of support members to be used in conjunction with the panel to be varied according to the needs of the particular opening being closed so as to avoid the presence of unnecessary, unused support members in some cases. The telescopic support members provide a particularly convenient way of providing such removable members. Preferably, the telescopic member includes means for urging the support member to its extended state, for example a spring operative between two telescoping portions of the support member.

In the first set of embodiments, the support member can be interlocked with the panel whereupon it can be offered to the opening in the building without the possibility of the support member sliding out of position. The interlocking means is preferably arranged so that the support beam can be fixed in position at a number of locations relative to the panel sidewalls to provide flexibility in the position of the connecting means when fastened to the support member.

Other forms of extendable support members could be employed with the present invention, for example an elongate support beam hinged at some point along its length with a releasable lock for locking it in a straight configuration.

The closure may be arranged such that the support member can be inserted under the rim portions of the panel and then moved laterally in the principal plane of the panel until the interlocking means is engaged to hold the support member position. The support member will be retained in position until the interlocking means is released at some future time so the support member can be slid to a different position on the panel or removed from it.

Preferably, the security closure is, on the other hand, arranged such that the interlocking means prevents the support member from being insertable under the rim portions unless the interlocking means is engaged. With this arrangement the support member is always fixed in position relative to the panel when it is retained by the rim portions and cannot undergo any sliding movement at all relative to the panel but has to be fully removed and replaced in the new position. This prevents the support beam being left within the panel at a position were it is able to slide about.

The interlocking means are conveniently provided at each end of the support member and the side wall of the panel but other portions of the support member and panel could be provided with the interlocking means if desired. For example, the support beam could engage with the rear surface of the front face of the panel.

Preferably, the interlocking means comprises opposed apertures in the side wall of the panel which interengage with a pin extending from each end of the support member. In the case of a rectangular panel having two pairs of opposed rearwardly extending side walls, the apertures can be in either or both pairs of opposed sidewall portions. However, if only one pair of opposed sidewall portions are provided with apertures it is preferred that the pair of side walls which are closest together are provided with the proposed apertures.

In the embodiment in which the support member has a pin at each end for engagement with an aperture in a side wall portion of the panel, a sufficiently long pin will be provided so that the support member can only be inserted into engagement with the rim portions when it is aligned with the aperture and therefore can only be inserted into the panel by engaging the interlocking means.

In a preferred form of first set of embodiments, opposed side walls diverge away from each other rearwardly of the face of the panel sufficiently to allow stacking of one panel within a like panel. For example, the face of the panel may be rectangular and the side walls comprise four, planar, trapezoidal, side wall portions. This form of panel greatly eases transportation of large numbers of the panels especially in the case where the support members are removable from the panel.

If the support beams are not removable from the panel, low-profile beams can be used to maximize the stacking depth of the closures.

In a second set of embodiments, an improved fixing arrangement is provided, in particular a quick release/fitting arrangement, and a method therefor.

According to a first aspect of the second set of embodiments, there is provided a retaining member for fixing an anchor bar of a security closure, comprising a fixed plate and a movable plate, the movable plate being biased from a release position where the plates are substantially parallel to a gripping position where the planes of the plates intersect, the plates each including an opening adapted to receive said anchor bar, where the two openings are aligned in a direction perpendicular to the plane of the plates when the movable plate is in the release position.

According to a second aspect of the second set of embodiments, there is provided a securing apparatus comprising an anchor bar and at least one retaining member as defined above.

According to a third aspect of the second set of embodiments, there is provided a method of securing a security closure on to a building, the method comprising either (i) the steps sequentially of:

(a) positioning the security closure on the exterior of the building, for example to cover a window;

(b) passing an end of an anchor bar attached to the security closure into the interior of the building;

(c) securing the anchor bar by inserting anchor bar into a retaining member which grips the anchor bar, the retaining member being mounted on a support structure;

or (ii) the sequentially steps of:

(a) positioning a support structure on the interior of the building, for example inside a window;

(b) passing to the exterior of the building, an end on an anchor bar fixed to the support structure;

(c) inserting the end of the anchor bar into a retaining member mounted on the security closure, the retaining member gripping the end of the anchor bar;

and optionally further including the step of:

(d) pulling the anchor bar to reduce the length on anchor bar between the security closure and the support structure, thereby clamping the building between the security closure and the support structure.

The embodiments are mainly used to secure a security closure for covering an opening in a building comprising a panel having a circumferential sidewall with inwardly-turned rim portions arranged for captively retaining at least one support member to which a retaining member can be slidably fastened for use in securing the closure over the opening. Preferably, the panel and the support member having an interlocking means which, when engaged, prevents lateral movement of the support member along the rim portions.

The retaining member has the advantage that it is simple to secure the bar in the securing mechanism, yet provides a very strong fixing of the bar. The bar itself is less expensive to manufacture because no threaded section is required. This also eliminates failure of the bars due to damaged thread, for example damage occurring when the bars are tensioned by a tensioning device.

The anchor bar may be rigid or flexible. If flexible, the anchor bar has rigid ends for fixing in the retaining member, but can be shaped to extend through a window light, etc. so that the security closure can be fitted without damaging the window, etc.

Preferably, the anchor bar can only be released from the retaining member either by push means inserted through a slot of the retaining member or by hitting the loosened security bolt. As mentioned above, the security closures are often fitted when a building is undergoing renovation or other works. Workman, for whatever reason, sometimes remove the security closures. This presents a major problem with the previously known closures because the closures are often incorrectly re-fitted, thus leaving the building less secure and/or present a hazard to people outside the building. These problems are largely overcome simply by the difficulty releasing the retaining means when tensioned, as most unauthorized workman would not know how to release the retaining members.

If necessary to prevent release of the retaining member, a security bolt is used to mount the spring, which bolt prevents compression of the spring unless an appropriate tool is used.

By the above-mentioned developments, it has been possible to provide far greater security to vacant buildings. This is particularly useful where buildings are vacant for a relatively long period of time during major renovation works.

One of the benefits of the systems presently used is that personnel within the building should not be able to remove a panel once installed. This reduces the instances that the building is left unsecured by the panel removal by unauthorized personnel.

One major disadvantage with the presently used panels and those described above is that the panels are not easily removed from either inside or outside the building. This disadvantage is most apparent when there is a fire or other emergency in the building. In these circumstances it may be that a personnel become trapped inside rooms of the buildings without access to the exits to the building. Of course, as the personnel will not be able to remove the panel from the inside of the building and emergency services cannot easily remove the panel from the outside of the building, personnel can become fatally trapped within the building.

The present invention seeks to provide a panel with an emergency release mechanism which allows at least some of the panels on a building to be released in the event of emergencies.

Preferably, the emergency release will indicate whether or not it has been used thus preventing unauthorized tampering with the emergency release system.

According to the present invention there is provided a security closure for covering an opening in a building comprising a panel with a circumferential sidewall, and a support member securable to extend across the opening in fixed relation thereto, the support member being releasably securable to the interior of the panel away from one edge thereof by releasable securing means to secure the panel over the opening with the sidewall abutting the building, and the support member being fixed at said one edge by hinged fixing means which allows the panel to pivot substantially along said one edge away from the opening when the support member is released from said releasable securing means.

As the support bar is only permanently fixed at one end to the panel the panel can be hinged away from the opening by means of the pivot provided on the end of the support member fixed to the edge of the panel.

In many cases the security closure will be provided with a plurality of the support members.

In the preferred embodiment of the invention, the hinged fixing means is fixed to the circumferential sidewall and, advantageously, the hinged fixing means provides movement of the panel away from the building prior to the said pivoting to allow a smooth movement of the panel even though the pivot axis is out of the plane of the wall. This prior movement may be provided by a second pivot provided in the hinged fixing means with an axis substantially parallel to the first-mentioned pivot and spaced along the support member further from the said one edge than the first-mentioned pivot.

In the preferred embodiment of the invention, the releasable securing means of the or each support member comprises a connecting anchor connecting the support member to a panel fixing mounted on the panel. The panel fixing may comprise a lever bracket which comprises a housing mounted on the interior of the panel with an opening on the interior side of the housing through which opening the connecting anchor is arranged to fit, the connecting anchor being fitted through said opening and engaged by a lever in the housing when the support member is secured by the releasable securing means, and the connecting anchor being dis-engaged from the lever and being removable from the housing when the support member is released from releasable securing means.

Preferably, the or each releasable securing means is releasable by means of release handle operatively connected to the or each securing means, the release handle being mounted on the interior of the panel.

The handle is advantageously positioned to be easily accessible from inside the building. This is accomplished by the handle position being independent of the releasable securing means position. This is particularly useful when the panel is installed over a window which has lights through which the handle can be made accessible. The independent positioning of the handle means that the fixing points of the support members fixings can be optimized in the panel as the fixings do not need to be accessible to any user.

It is advantageous if an indicator is provided which indicates whether or not the releasable securing means have been released.

BRIEF DESCRIPTION OF THE DRAWING

Embodiments of the present invention will now be described with reference to the accompanying drawings of which:

FIG. 1 is a schematic perspective view of a security closure embodying the present invention;

FIGS. 2 to 4 are schematic cross-sectional views of the security closure in the direction 2—2 of FIG. 1 showing the stages of insertion and engagement of the support member with the panel of FIG. 1.

FIG. 5 is a sectional view of a security closure of FIG. 1 fitted to a building;

FIG. 6 shows a stack of the security closures of the type illustrated in FIG. 1 with the support members removed;

FIG. 7 shows a perspective view of a retaining member embodying the present invention;

FIG. 8 shows the retaining member of FIG. 7 in a gripping position;

FIG. 9 shows the retaining member of FIG. 8 in a release position;

FIG. 10 shows the retaining member of FIG. 7 securing a security closure over an window in a building;

FIG. 11 shows a sectional view along the line 11—11 of FIG. 10;

FIGS. 12 to 16 show an embodiment of the security closure of the present invention fitted with an emergency release mechanism;

FIG. 12 shows a partial cross-section plain view through a security closure according to the present invention when mounted on a building in its secured position;

FIG. 13 shows the cross-sectional plain view of FIG. 12 with the security closure in its released position;

FIG. 15 shows a rear internal view of a security closure according to the present invention; and FIG. 16 shows an alternative means of fixing the support member in the panel of the present invention.

DETAILED DESCRIPTION OF THE PREFERRED EMBODIMENT

Figure 1:
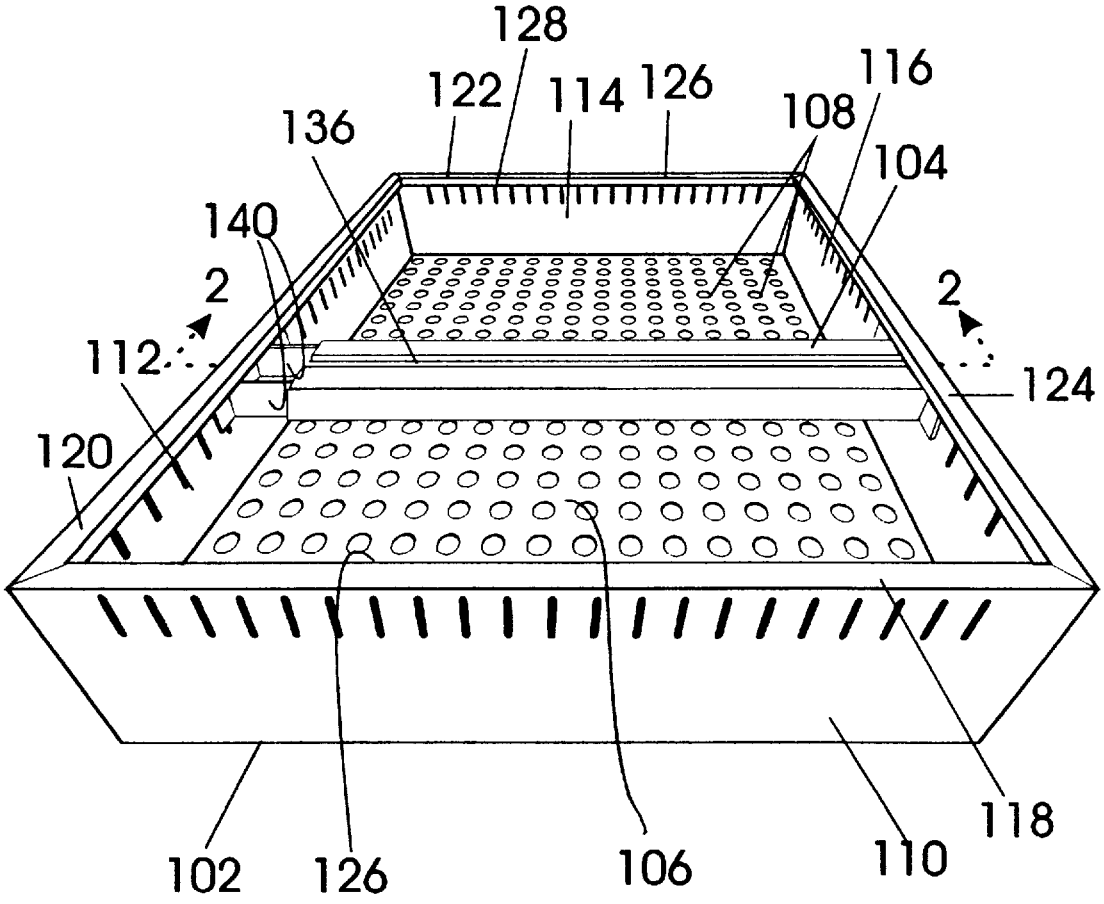
FIGS. 1 to 6 show a first set of embodiments relating to the fixing of a support member in the panel.

Referring to FIG. 1, a security closure comprises a panel 102 and an elongate, telescopic support member 104.

The panel 102 is formed from a cut and folded sheet of galvanized steel. This embodiment has a rectangular face 106 through which are punched an array of regularly spaced through-holes 108 which make ventilation and light available to the interior of a building to which the panel 102 is applied without allowing access to the support beam 104 so as preserve the security of the closure. The panel has four side wall portions 110, 112, 114, 116, which bound the periphery of the rectangular front face 106. The side walls 110, 112, 114, 116 are trapezoidal and opposed pairs of side walls diverge away from the face plate 106. The top of each side wall portion 110, 112, 114, 116 is provided with an inwardly-turned, L-shaped rim 118, 120, 122, 124 as is more clearly shown in FIGS. 2 to 4.

Each rim 118, 120, 122, 124 has an upper planar portion 126 (in the orientation of the closure as depicted in the Figures) parallel to the front face 106 which in use of the panel is placed in abutment with the portion of the building surrounding the opening to be closed. The innermost portion of each of the rims 118 is in the form of a lip downwardly extending lip 128 extending towards the front face 106 parallel with the respective side wall 110, 112, 114, 116.

Each of the side wall portions 110, 112, 114, 116 of the panel 102 is provided with a row of regularly spaced apertures 130 which constitute part of the interlocking means preventing lateral movements of the support member 104 as will be described in more detail later.

The apertures 130 are generally rectangular with curved top and bottom edges and have their principal axes perpendicular to the plane of the front face 106.

Figure 2:
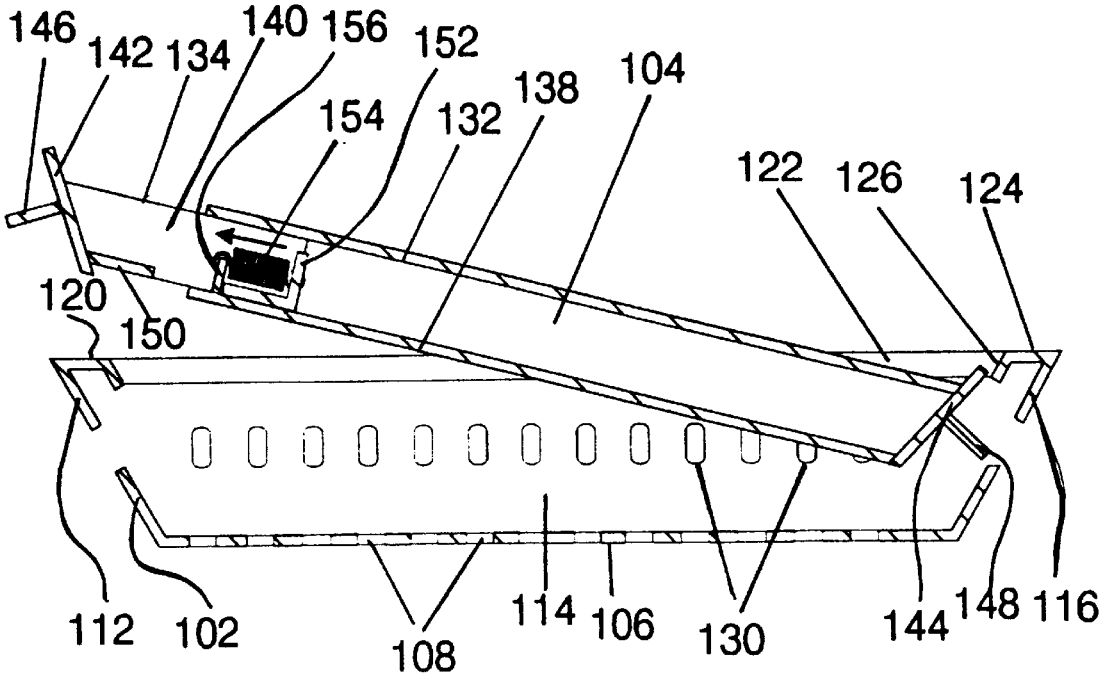

Referring now also to FIG. 2, the support member 104 is telescopic and comprises a first elongate beam 132 of C-shaped cross section within which is received a second elongate beam 134 of U-shaped cross section.

The first beam 132 is in the form of a generally rectangular tube with an open channel or slot 136 in the uppermost face of the beam 132.

A connector (not shown) can be inserted through the slot 136 and fixed to the support member 104 by means of a captive locking mechanism (not shown), for example, retained within the support member 104 in known fashion.

The second beam 134 has a planar base 138 and a pair of opposed, parallel side walls 140 extending upwards at right angles to the base 138.

The end of the second beam 134 which projects from within the first beam 132 is capped with a rectangular plate 142 which extends above the side walls 140. The end of the first elongate beam 132 furthest away from the plate 142 is capped with a similar rectangular plate 144 which similarly extends above the second elongate beam 132.

The ends of the first and second elongate beams 132 and 134 to which the plates 144 and 142, respectively are fixed are angled such that the plates 142 and 144 diverge at the same angle as each pair of opposed side walls and so are parallel to those side walls when the side beam 104 is parallel to the face plate 106 and the other two side walls 110 and 114 in the arrangement shown in the Figures.

Cylindrical pins 146 and 148 are welded perpendicularly to the centers of each of the plates 142 and 144 respectively. The pins 144 and 146 are dimensioned to be receivable by the apertures 130 in side wall portions 110, 112, 114, and 116.

The base 138 of the second beam 134 is provided with a central slot 150 which extends the length of the second elongate beam 134. A metal plate 152 is welded in position across the second elongate beam 134 between the side walls 140 with a through-hole in the plate 152 forming a first anchor point for a first end of a spring 154.

The base 138 of the first beam 132 has an upstanding tab 156 formed by punching through a portion of the base 138 and dimensioned so it can move within the channel 150 in the second beam 134. A through-hole is provided in the tab 156 to provide a second anchor point to the second end of the spring 154.

Figure 3:
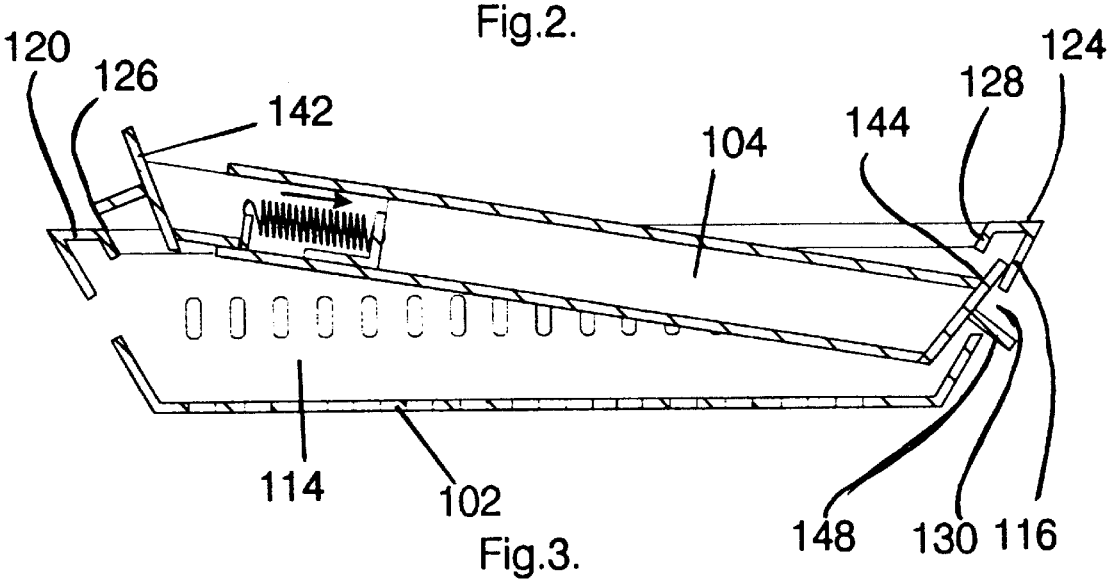

The spring 154 urges the plate 152 and the tab 156 together thereby urging the first portion 134 to telescope out of the first portion 132 to the position as shown in FIG. 2. The support beam 104 can be shortened by pressing the second beam 134 into the first beam 132 by hand to the position as shown in FIG. 3. When in this shortened configuration the support beam 104 can be placed within the side walls 110, 112, 114, 116 of the panel 102 beneath the rims 118, 120, 122, 124. The support member 4 is shown partially inserted into the panel 102 in FIG. 3.

The length and position of the pins 146 and 148 is such that the support beam 104 cannot be located beneath the rim unless the pins 146 and 148 each enters one of the apertures 130 as shown in FIG. 3. If the pin 148 is not aligned with one of the apertures 130 the length of the pin 148 is such as to prevent the plate 144 from getting close enough to the sidewall 116 to allow the plate to be received under the rim portions 124 and 128.

When the pin 148 is aligned with an aperture 130 the other end of the support member 104 can likewise be aligned with an aperture directly opposite that in which the pin 148 has entered to allow the plate 142 to lie beneath the rim 120, 126.

Figure 4:
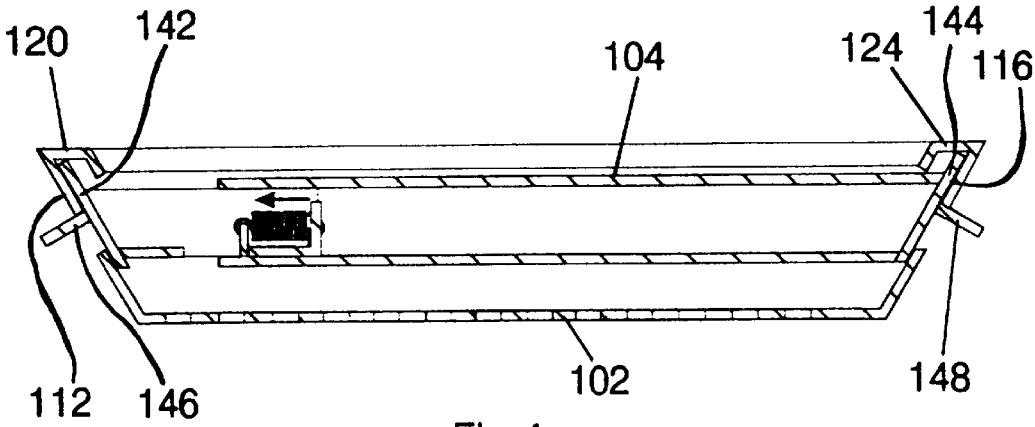

On then releasing the first and second beams 132, 134, the support beam 104 telescopes outwards under the action of the spring 154 to push the plates 142, 144 into contact with the side walls 112, 116, respectively as shown in FIG. 4. The support member 104 is now fixed in position within the panel 102 which can now be moved without the support member 104 sliding from the selected position.

Figure 5:
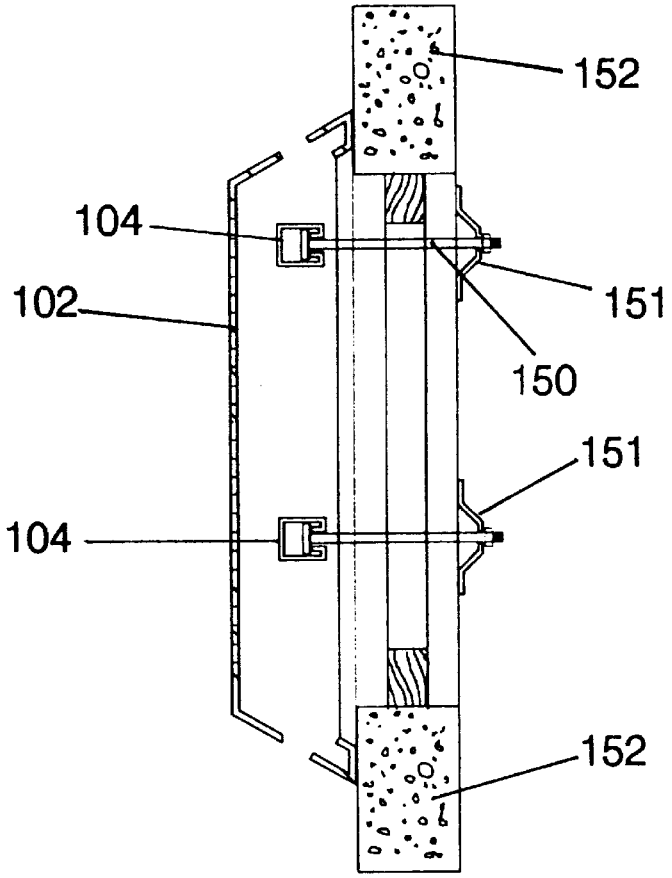

When the panel 102 and support member 104 are fixed to a first side of an opening by a connector means 150 fastened to the support member 104 and secured to an anchor beam 151 (as shown in FIG. 5) spanning the opening on the other side of the building 152, the support member 104 is pulled away from the front panel 106 until the plates 142, 144 of the support member 104 are engaged with the underside of the rims 120, 124, respectively, to press the rim portions against the surround of the opening being covered by the closure. The present invention is not restricted to a particular way of securing the security closure to the opening of the building and any convenient anchor and connecting means can be employed. However, a particularly advantageous securing system is described in the second set of embodiments described hereinafter.

If the pins 146 and 148 are sufficiently shorter than shown in FIGS. 2 to 4 then it becomes possible to slide the support beam 14 from one aperture to another whilst the plates 142 and 144 are retained by the rims 120, 124. In this case the support member can be moved parallel to the front face 106 of the panel 102 until the desired position has been found whereupon the second elongate beam 134 can be released to allow the pins to extend into another pair of opposed apertures.

Figure 6:
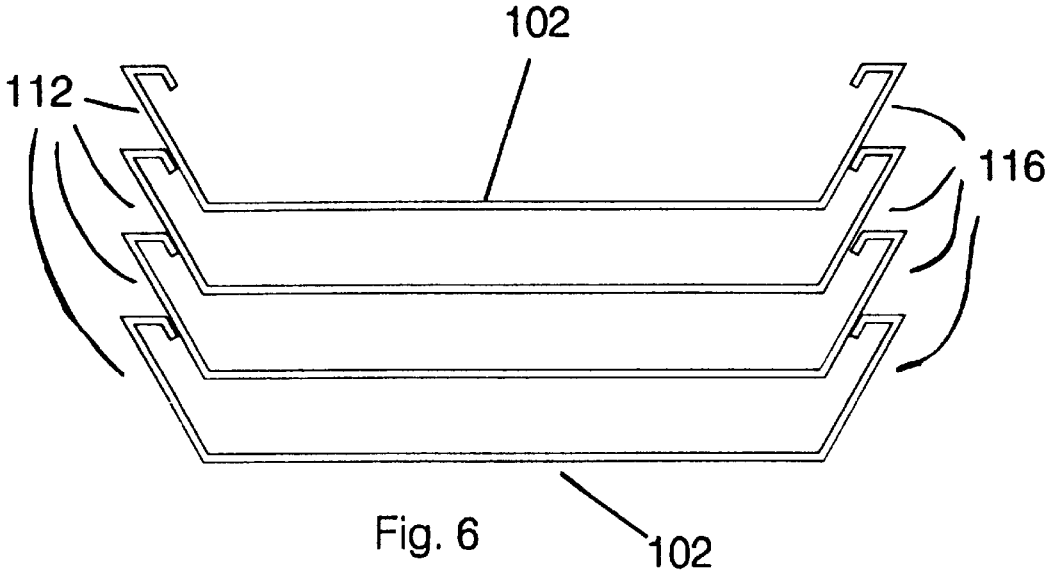
Figure 7:
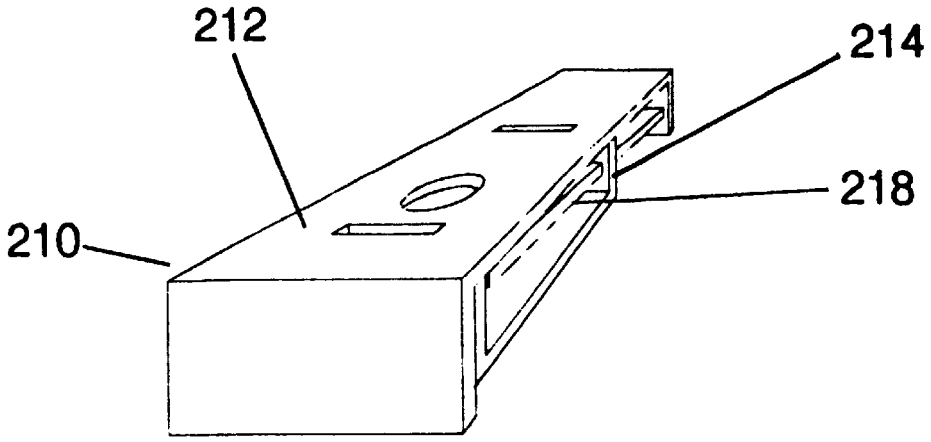
FIGS. 7 to 11 show a second set of embodiments which relate to the fixing of the security closure on to the building.
Figure 8:
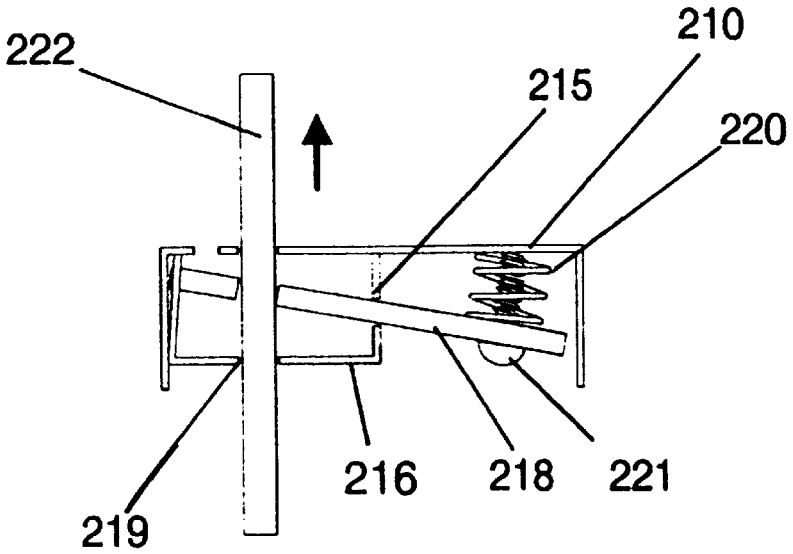

FIG. 6 shows a stack of panels 102 in which the support beams 104 have been removed. This removal and the outwardly turned side walls 110, 112, 114, 116 provide particularly convenient and compact storage of the panels 102.

Turning now to the second set of embodiments shown in FIGS. 7 to 11, a retaining member 210 comprises a plate section 212 made from steel. On inner side of the plate section 212 a housing 214 is formed. An opening in the plate section 212 is located above the housing 214. The housing 214 comprises side walls 215 extending perpendicularly from the plate section 212 and an end wall 216 extending between the side walls 212 parallel with the plate section. The end wall 216 has an opening aligned with the opening in the plate section 212.

A movable plate 218 is mounted across the housing 214 between the end wall 216 and the plate section 212. The movable plate 218 is movable between a release position parallel with the plate section 212 and a gripping position where one end of the movable plate 218 is moved towards the plate section 212.

The movable plate 218 has an opening aligned with the opening in the plate section 212 when the movable plate 218 is in the release position. The movable plate 218 being biased by spring 220 into the gripping position.

A bar 222 is sized to fit closely through said three openings. One end of the bar 222 can be pushed through all three openings from the outer side of the plate section 212, or through the opening in the end wall 216 of the housing 214. Of course the openings in the fixed plates 212, 216 can be made much larger as the fixed plates 212, 216 are not necessary for the gripping function of the retaining member 210, but greater movement of the movable plate 218 would be required in these circumstances.

When the bar 222 is inserted through the openings, the movable plate 218 attempts to return to its gripping position. The edges 219 of the opening in the movable plate 218 frictionally engage the bar 222 to prevent movement of the bar 222 back out of the openings (in the direction of the arrow shown in FIG. 8).

Figure 9:
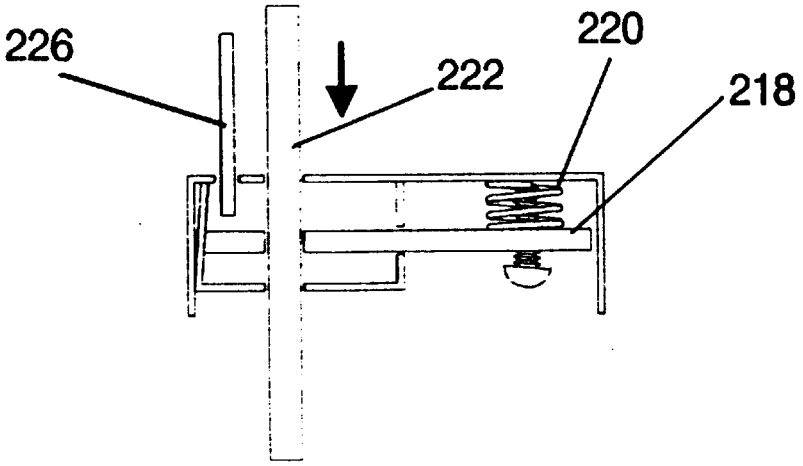

A slot is provided in the plate section 212, through which a push member 226 is insertable (as shown in FIG. 9). The push member 226 abuts against the end of the movable plate 218 on the end distant from the spring 220 when inserted through the slot. When the push member 226 is pushed it applies a force to the said distant end of the movable plate to counter the biasing force provided by the spring 220. The movable plate 218 is thus moved to its release position. The bar 222 can then be withdrawn from the openings. The push member 226 is then removed from the slot.

Figure 11:
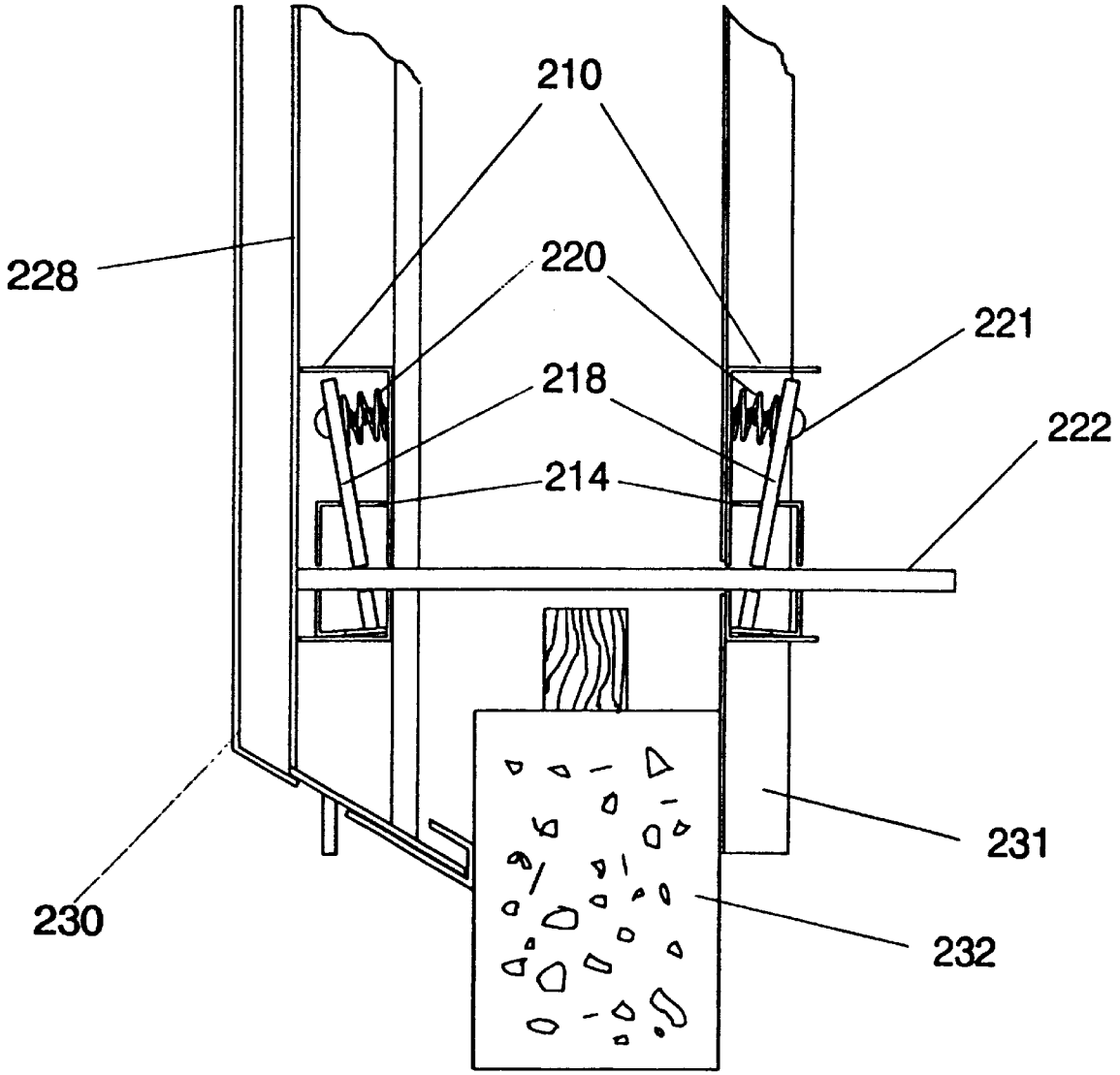

When the retaining member 210 is used to secure the anchor bar 222 on the inside of the building, the end of the movable plate 218 on which the spring 220 acts is directly accessible (as shown in FIG. 11). In order to prevent accidental or unauthorized release of the retaining member 210, the spring 220 is mounted on security bolt 221. This prevents compression of the spring 220 unless the bolt is undone. This stops spring 220 compression even if the bolt is hit by a hammer or otherwise forced.

Figure 10:
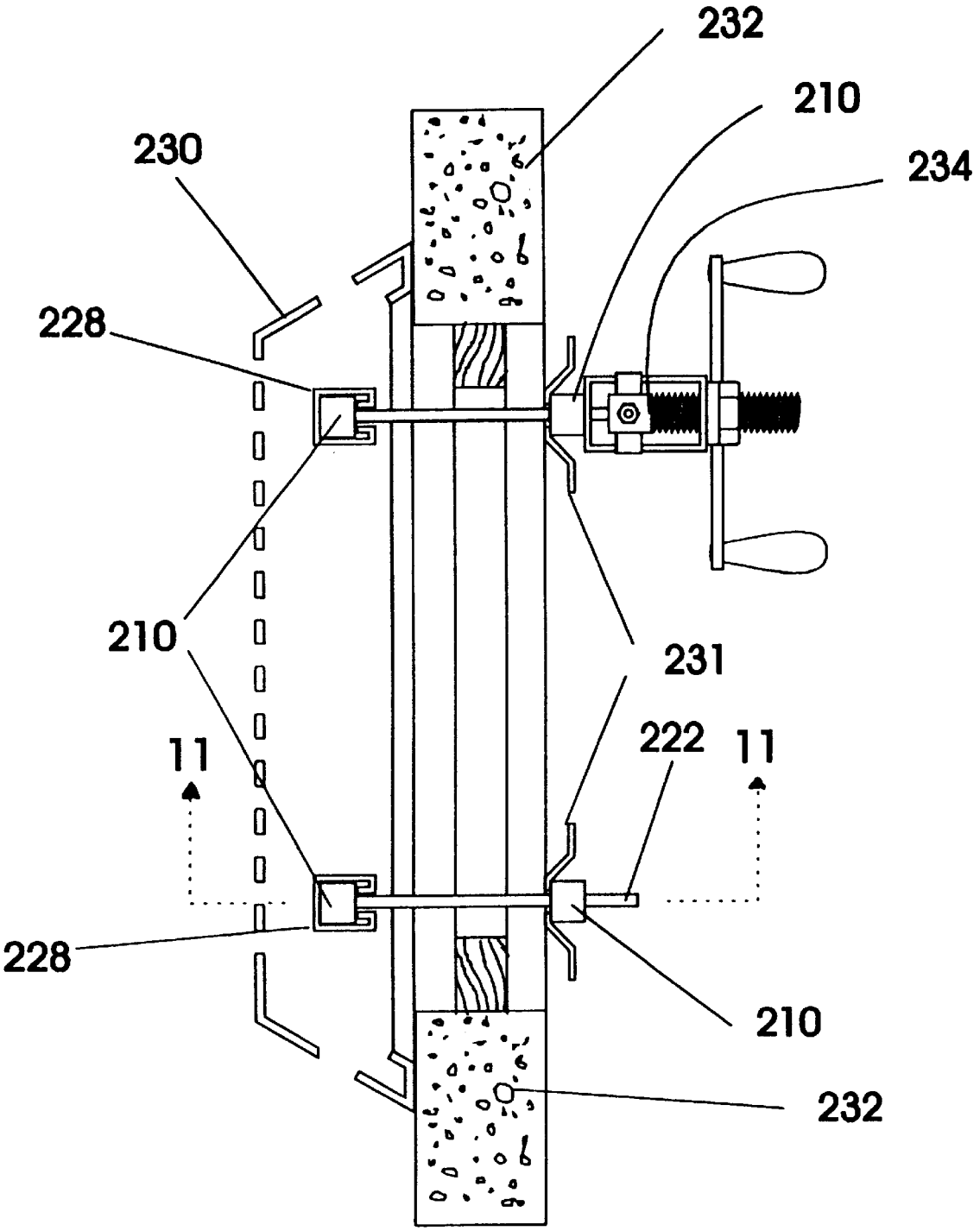

As shown in FIG. 10, a security closure 230 is secured over a window, or other opening, of the building 232. A first retaining member 210 is fitted onto a support beam 228 of the security closure 230. The support beam 228 is secured in the rim of the security closure 230 between preset positions. The first retaining means 210 is slidable along the support beam 228. One end of the bar 222 is inserted into the openings of the retaining member 210 from the direction of the end wall of the housing 214, i.e. outwardly from the building.

The other end of the bar 222 is inserted through a hole in the window of the building 232. The other end of the bar 222 is similarly inserted into another retaining member 210, inwardly to the building 232. The second retaining member 210 is mounted on a support structure 231 mounted in the interior of the building 232. The bar 222 is pushed right through second retaining member 210 to extend inwardly to the building. A tensioning device 234 is used (if required) to pull the said other end of the bar 222 inwardly to the building. This pulling secures the security closure 230 onto the building 232 by clamping the building 232 between the security closure 230 and the support structure 231. The ends of the anchor bar 222 are not threaded and so the tensioning device 234 advantageously does not damage such threaded sections.

The retaining members 210 are both arranged so that the movable plate 218 of each of the retaining members 210 prevents removal of the bar 222 from the respective retaining member 210 in the direction towards the window. The arrangement thus prevents any slack being generated between the security closure 230 and the support structure 231.

The only way to release the bar 222 is to undo the security bolt 221 and then compress spring 220 on the second retaining member 210. No push member 226 can be inserted through the slot of the first mentioned retaining member 210 because of the security closure 230.

Once tensioned the security closure 230 is securely mounted across an opening in a very quick and easy manner. The security closure cannot be released as soon as the other end of the bar 222 is inserted into the second retaining means 210.

In other versions of the second set of embodiments (not shown) a quick release/fitting is only required on one end of the anchor bar. In these cases the retaining member 210 is only fitted on one end of the anchor bar. The other end of the bar is then fixed in another manner.

The above described first and second sets of embodiments are included herein to fully set out the advantageous types of panel often used in conjunction with the security closure with emergency release mechanism described herein below.

Figure 12:
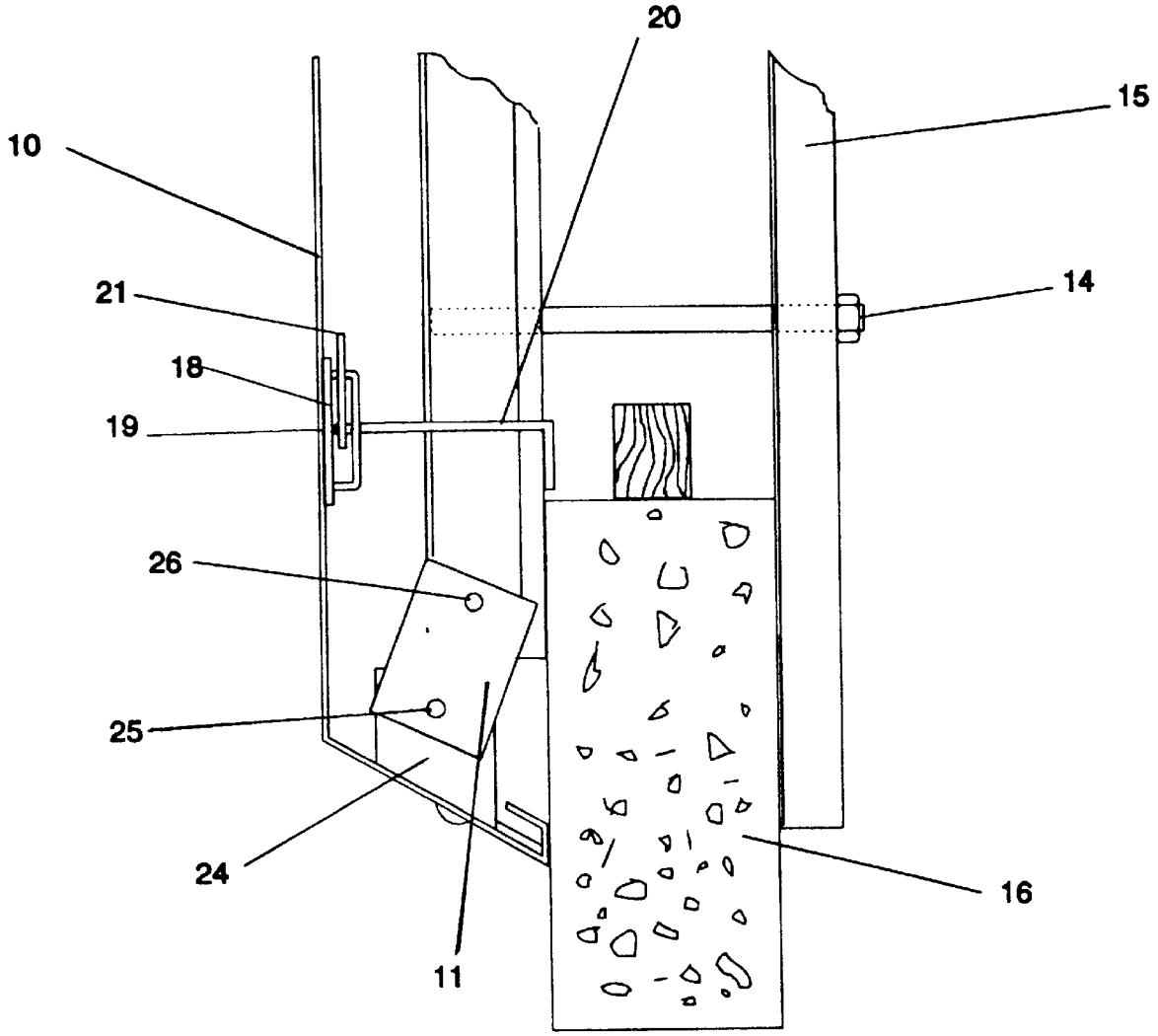
Figure 13:
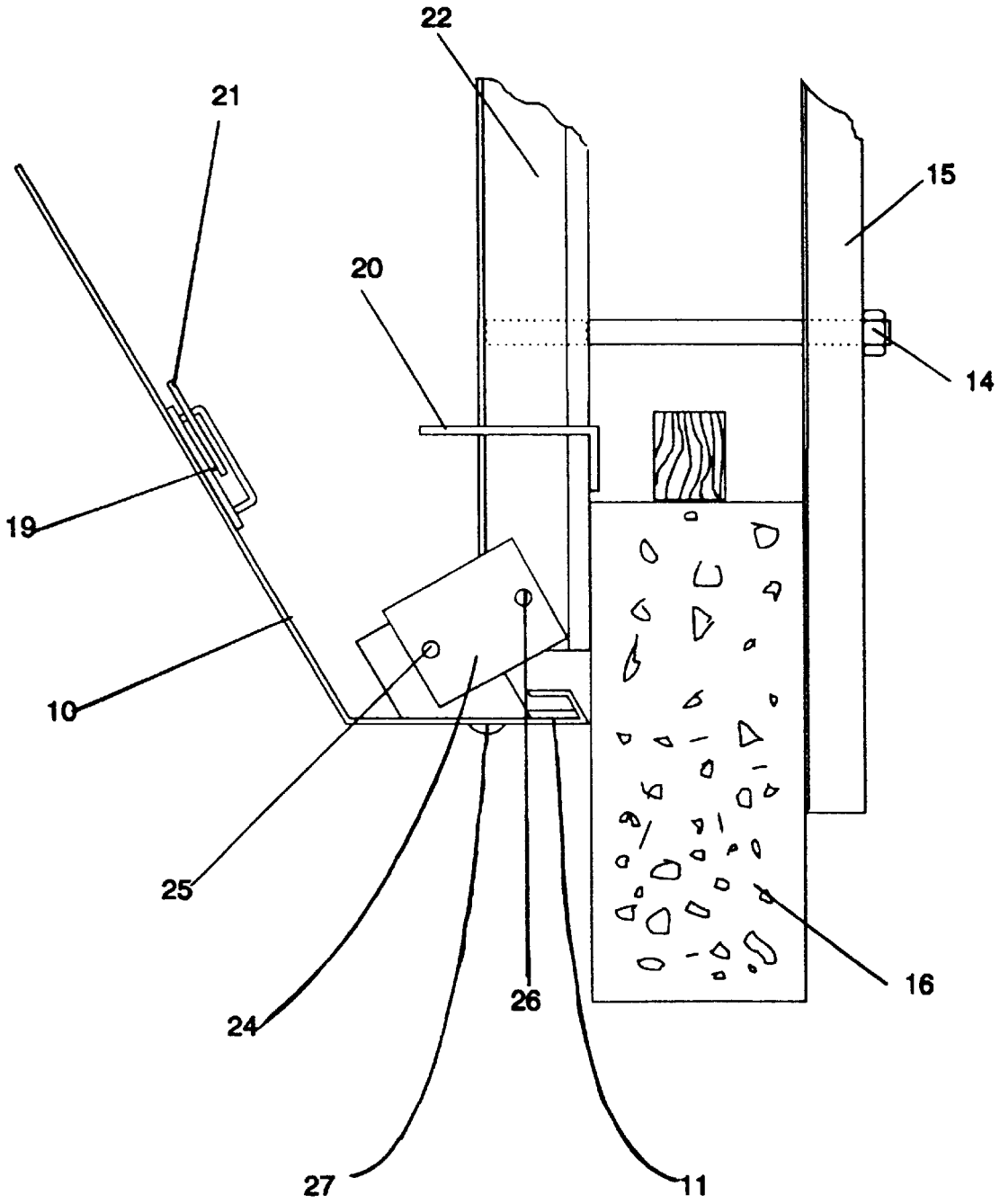
Figure 14A:
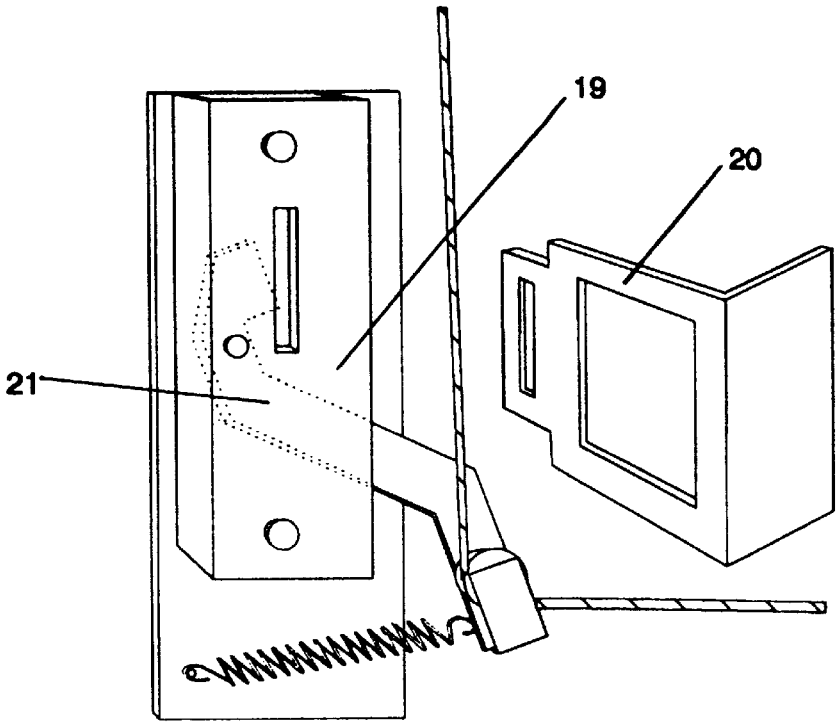
FIG. 14A shows a view of a release catch used with the security closure of FIG. 12 in a release position.
Figure 14B:
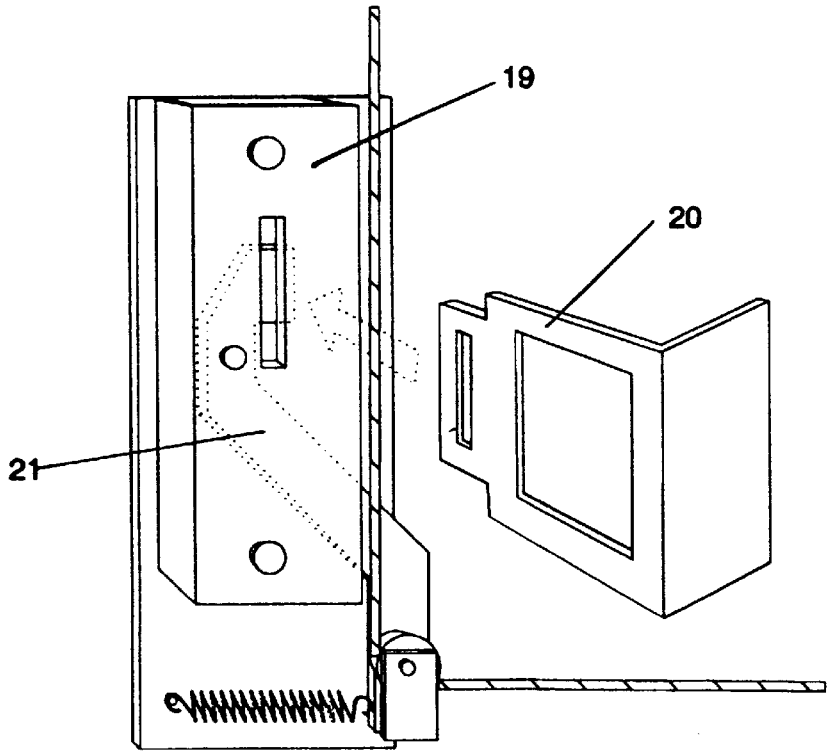
FIG. 14B shows a view similar to that of FIG. 14A with the release catch in a secure position.

FIG. 12 and FIG. 13 show a detail of a security closure with an emergency release mechanism according to the present invention fitted over an opening, such as a window, in the wall of the building 16. The panel 10 is normally formed from sheet metal but may be formed from other suitable materials. The panel 10 has a circumferential side wall 11. The circumference of the side wall 11 is arranged to completely surround the opening in the building 16.

The security closure of the illustrated embodiment is fitted onto the building 16 by a bracing arrangement between a support beam 22 of the security closure extending across the opening on one side of the wall of the building 16 braced to an interior beam 15 extending across the opening on the opposite surface of the wall of the building 16. In the illustrated embodiment, the support beam 22 is connected to the interior beam 15 by means of stud and nut arrangement 14. Alternative means of securing the support member 22 in relation to the opening could also be used, for example those disclosed above. Normally the support beam 22 extends completely across the opening, but embodiments where the support beam 22 only extends partially across the opening or forms a brace between the opposed edges of the opening are also with the scope of the invention.

The support beam 22 thus provides a fixed support for the panel 10. The panel 10 is securable to the support beam 22 in two positions.

The panel 10 is releasably secured to the support beam 22 by the releasable securing means generally designated 18. The releasable securing means 18 comprises a lever bracket 19 and a connecting anchor 20. The lever bracket 19 is mounted on the interior surface of the panel 10. The connecting anchor 20 extends through the support beam 22 towards the interior surface of the panel 10. In the position shown in FIG. 12 where the releasable fixing means 18 secures the panel 10 to the support member 22, the connecting anchor 20 is held by the lever bracket 19 by engagement of the lever 21 on the connecting anchor 20. When the lever 21 is disengaged from the connecting anchor 20, the panel is movable to the position shown in FIG. 13 (the "release position") where the connecting anchor 20 is removable from the lever bracket 19. Of course, it would be possible to arrange the release mechanism on the support member 22 rather than on the interior of the panel 10.

The panel 10 is also connected to the support member 22 by the hinged fixing means generally designated 24. A housing portion of the hinged fixing means 24 is shown connected to the circumferential side wall 11 by means of a security bolt 27. Alternatively, the hinged fixing means 24 could be secured to the side wall or panel in other ways, for example as shown in our aforementioned earlier patent applications. A second part of the hinge fixing means 24 is connected to the support member 22. The housing portion is connected to the second portion by pivot 25 about which the housing portion and the second portion pivot with respect to one another along an axis extending generally parallel to the wall of the building 16.

In the illustrated embodiment, the second portion of the hinged fixing means 24 is fitted to the support member 22 by means of a pivot 26 which allows pivoting movement of the second portion about an axis parallel to but spaced from the first said axis. Whilst the panel 10 could pivot simply with the first mentioned axis, the illustrated embodiment is preferred as it allows movement of the panel 10 away from the wall before the panel 10 pivots. This allows a smoother pivoting motion of the panel 10.

When the releasable securing means 18 has been moved into its release position the panel 10 can pivot about the hinged fixing means 24 into the position shown in FIG. 13. As will be appreciated, a person inside the building could then release the panel 10 and attract the attention of the emergency services from the window. If the height of the window was relatively small it would even be possible for a person to jump from the window. If the height was greater it would be possible for a ladder to be provided to the window or for the person to jump onto a safety mattress. However, this cannot be seen as an emergency escape as there would not normally be provided a means to travel from the opening/window to ground level.

Normally the hinged fixing means 24 will be fitted to the top or side edge of a panel 10 when the security closure is considered in relation to the building 16.

The lever 21 is normally operated via a handle mechanism 30. Visual indication means are normally provided to show whether or not the handle has been actuated. This provides ready indication whether or not the window has been released by an unauthorized personnel. Also the releasable securing means 18, may be biased so that the anchor bar 20 cannot be re-secured in the lever bracket 19 without disassembly of the releasable securing means 18.

Figure 15:
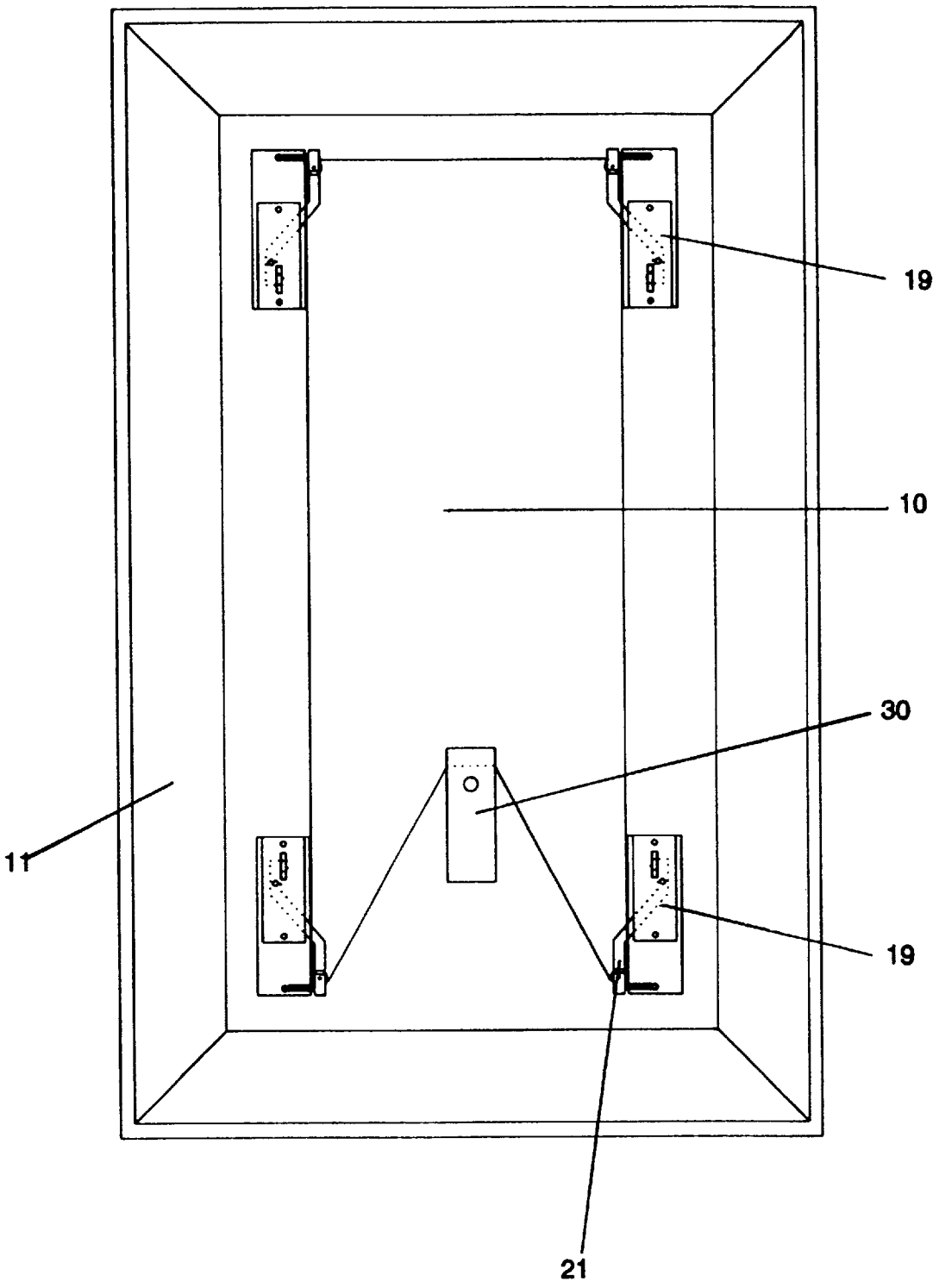

In many instances, the panel 10 will be fitted to two support members 22, each having a hinged fixing means 24 along the same edge as the panel 10. Whilst it is not always necessary for each support member to have a releasable securing means 18, it is preferred if each supporting member 22 is so linked to the panel 10. In cases where each supporting member 22 is connected to the panel 10 via a releasable securing means 18, all of the releasable securing means 18 can be operated by the same handle 30 as shown in FIG. 15. The handle 30 can be positioned anywhere on the interior surface of the panel 10. Thus, in any particular installation, the position of the handle can be determined so that the releasable securing means 18 can be transferred to its release position, through the window from inside the building 16.

Figure 16:
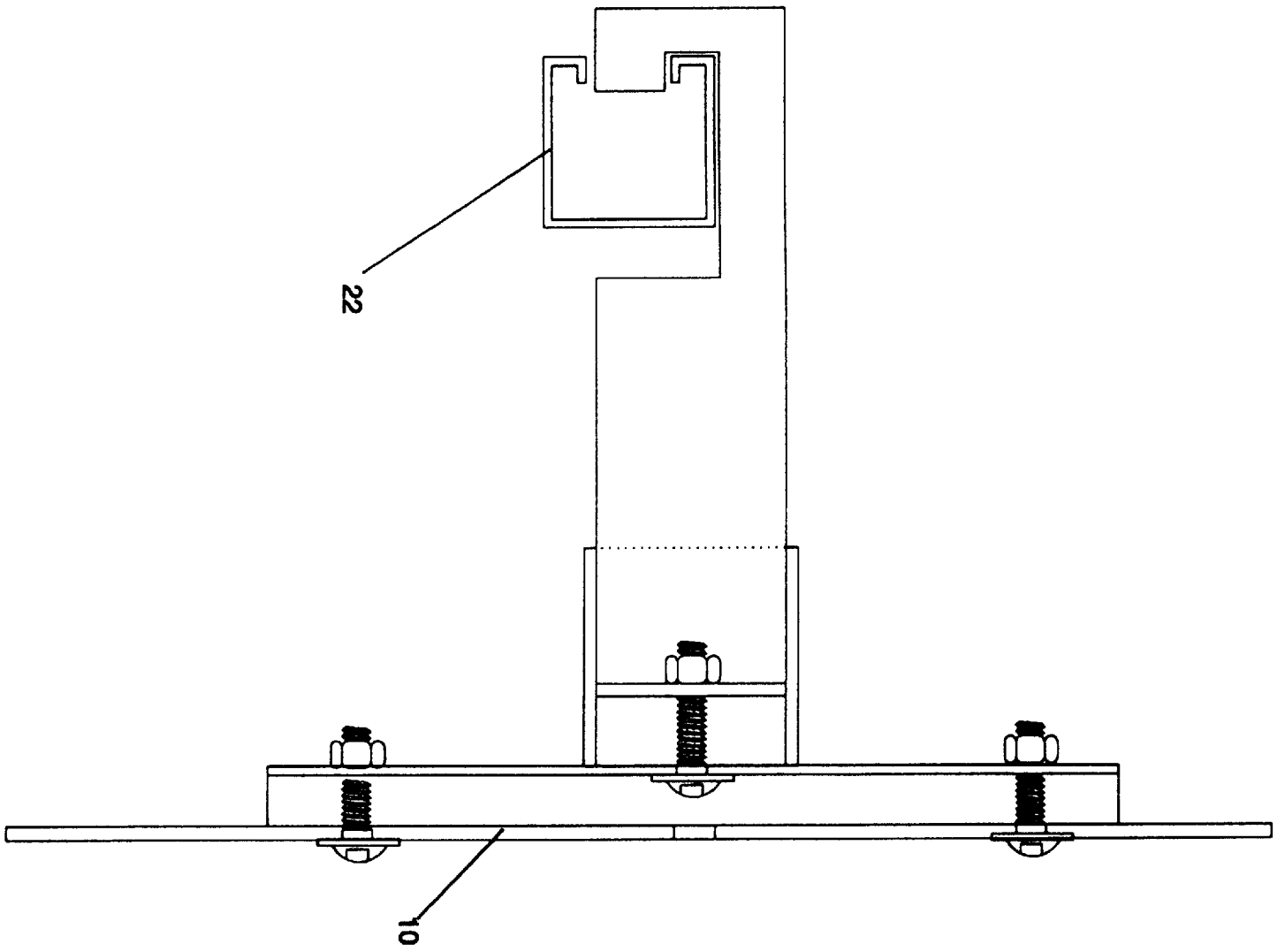

An alternative way that the support beam 22 could be fitted is shown in FIG. 16. This fixing provides particularly simple way to fix the supporting member.

It should be borne in mind that it remains important that no way to release the panel 10 is available from the exterior of the building when the panel 10 is in use. Accordingly, any bolts which extend through the panel 10 will normally be security bolts which cannot be removed in the absence of specially designed tools.

It will no doubt be appreciated that in most installations numerous panels are fitted to the building. It will normally only be necessary to fit the panels 10 of the present invention to a limited number of the openings in the building 16. Of course, these panels can be fitted to other openings apart from windows, such as doors, provided that entry and exit through the opening is not normally required.

Of course the various fixing arrangements described in the first set of embodiments, the second set of embodiments and the embodiments of the invention may all be used in conjunction with one another as will readily apparent to the skilled person, though it is not preferred to have an emergency release support bar fitted to the same panel as the support bars of the first set of embodiments.

What is claimed and desired to be secured by Letters Patent of the United States is:

1. A security closure for covering an opening in a building comprising a panel with an interior and a circumferential sidewall having opposed side sections, the closure further including a support member securable to extending between said opposed side sections and being securable adjacent opposed ends of said support member to fix said closure on said building, a releasable securing means for releasably securing said support member to said interior of said panel away from one edge of said panel, said releasable securing means comprises a connecting anchor connecting said support member to a bracket housing mounted to said interior of said panel with an aperture on an interior side of said bracket housing through which aperture said connecting anchor is insertable, such that when said connecting anchor is inserted through said aperture and engaged by a lever in said bracket housing said support member is secured to said panel by said releasable securing means, and when said connecting anchor is disengaged from said lever and is removed from said bracket housing said support member is released from said panel, and hinged fixing means for fixing said panel at said one edge such that said panel is permitted to pivot substantially along said one edge when said support member is released from said panel, said hinged fixing means being within said circumferential sidewall when said support member is secured to said interior of said panel by said releasable securing means.

2. The security closure according to claim 1, wherein said hinged fixing means includes a first pivot and permits movement of said panel away from said support member prior to said pivoting.

3. The security closure according to claim 2, wherein said hinged fixing means includes a second pivot for permitting said movement of said panel away from said support member, said second pivot having an axis substantially parallel to said first pivot and spaced along said support member further from said one edge than said first pivot.

4. The security closure according to claim 1, wherein said releasable securing means is releasable by means of a release handle operatively connected to said releasable securing means, said release handle being mounted on said interior of said panel.

5. A security closure according to claim 4, wherein the position of said release handle is independent of the position of said releasable securing means.

6. The security closure of claim 4, further including a plurality of releasable securing means each associated with a respective support member, and wherein said release handle operates all of said releasable securing means.

7. The security closure according to claim 1, wherein said releasable securing means is releasable by means of a release handle operatively connected to said releasable securing means, said release handle being mounted on said interior of said panel.

8. A security closure for covering an opening in a building comprising a panel with an interior and a circumferential sidewall having opposed side sections, the closure further including a support member securable to and extending between said opposed side sections and being securable adjacent opposed ends of said support member to fix said closure on said building, a releasable securing means for releasably securing said support member to said interior of said panel away from one edge of said panel, said releasable securing means being releasable by means of a release handle operatively connected to said releasable securing means, said release handle being mounted on said interior of said panel and the position of said release handle being independent of the position of said releasable securing means, and hinged fixing means for fixing said panel at said one edge such that said panel is permitted to pivot substantially along said one edge when said support member is released from said panel, said hinged fixing means being within said circumferential sidewall when said support member is secured to said interior of said panel by said releasable securing means.

9. The security closure according to claim 8, wherein said hinged fixing means is fixed to said circumferential sidewall.

10. The security closure according to claim 8, wherein an indicator is provided which indicates whether said releasable securing means has been released.

11. The security closure according to claim 8, wherein said hinged fixing means includes a first pivot and permits movement of said panel away from said support member prior to said pivoting.

12. The security closure according to claim 11, wherein said hinged fixing means includes a second pivot for permitting said prior movement, said second pivot having an axis substantially parallel to said first pivot and spaced along said support member further from said one edge than said first pivot.

13. A security closure for covering an opening in a building comprising a panel with an interior, a support member securable with respect to said opening, a releasable securing means for releasably securing said support member to said interior of said panel away from one edge thereof to thereby secure said panel with respect to said opening, said releasable securing means comprising a connecting anchor connecting said support member to a bracket housing mounted to said interior of said panel with an aperture on an interior side of said bracket housing through which aperture said connecting anchor is insertable, such that when said connecting anchor is inserted through said aperture and engaged by a lever in said bracket housing said support member is secured to said panel by said releasable securing means, and when said connecting anchor is disengaged from said lever and is removed from said bracket housing said support member is released from said panel, and hinge means for pivotably connecting said panel to said support member whereby said panel is permitted to pivot away from said opening when said support member is released from said panel.

* * * * *